United States Patent [19]

Borenstein

[11] Patent Number: 4,733,467

[45] Date of Patent: Mar. 29, 1988

[54] METHOD AND APPARATUS FOR COOLING A RAZOR

[76] Inventor: Charles Borenstein, 445 N.E. 195th St., North Miami Beach, Fla. 33179

[21] Appl. No.: 874,590

[22] Filed: Jun. 16, 1986

Related U.S. Application Data

[63] Continuation-in-part of Ser. No. 710,419, Mar. 11, 1985, Pat. No. 4,642,893.

[51] Int. Cl.[4] ..... B26B 19/44

[52] U.S. Cl. ..... 30/41; 30/90

[58] Field of Search ..... 30/32, 41, 41.5, 90; 134/117, 182, 183, 198, 200; 222/148–151

[56] References Cited

U.S. PATENT DOCUMENTS 4,480,387 11/1984 d'Alayer de Costemore d'Arc ..... 30/90 X

*Primary Examiner*—Douglas D. Watts

*Attorney, Agent, or Firm*—Dale Paul DiMaggio

[57] ABSTRACT

A cooling device and method for use in conjunction with a razor having a head which includes at least one blade. Disclosed is a means for containing a coolant, a means for selectively releasing the coolant from the container, and a means for receiving a head of a razor. The receiving means communicates with the releasing means and includes means for exposing the razor head to the coolant when the razor head is placed within the receiving means. Upon activation of the releasing means the head of the razor is exposed to the coolant which substantially cools the razor. The coolant thermodynamically contracts and sharpens the razor blades allowing for a more efficient and pleasant shave.

14 Claims, 3 Drawing Figures

METHOD AND APPARATUS FOR COOLING A RAZOR

This application is a continuation-in-part of Ser. No. 710,419, filed Mar. 11, 1985, now U.S. Pat. No. 4,642,893.

BACKGROUND OF THE INVENTION

The subject matter of this invention relates to a shaving device, and more particularly for a cooling device for use in conjunction with a conventional razor having one or more blades in the head of said razor.

The shaving industry has traditionally relied upon principles of heating shaving implements such as safety razors and shaving creams to provide a more comfortable shave. Thus, a user will commonly shave using hot water or heated shaving creams to treat the skin. It is conventionally believed that the heat favorably softens the skin and allows for a closer shave.

There have been a substantial number of devices which utilize a heating theory and include, inter alia, the heating of shaving creams, the razor head itself, or the skin of the user in preparation for the shave.

The present invention utilizes principles which are in contradiction to the prior art. This invention relies on the principles of thermodynamically cooling the blades of a razor in a very substantial way which causes contraction of the metal blades and a resultant sharpening of the blades. At the same time, the razor head is substantially cooled, or frozen, and then immediately applied to the skin. This allows for a much more efficient, and suprisingly, pleasant shave than that taught by the prior art.

It is therefore highly desirable to provide a method and apparatus for cooling the head of a razor having one or more blades, thereby thermodynamically contracting and sharpening the razor blades and allowing for a more efficient and pleasant shave.

It is also highly desirable to provide a method and apparatus for cooling the head of a razor which is cost effective and yet efficient in use.

It is also highly desirable to provide a method and apparatus for cooling the head of a razor which is inherently safe and requires no modification of the razor head itself.

It is also highly desirable to provide a method and apparatus for cooling the head of a razor which can be utilized on any conventional razor having one or more blades, the apparatus and method being readily modifiable to correspond to the dimensions of any given razor.

It is also highly desirable to provide a method and apparatus for cooling the head of a razor utilizing structure which allows for ease of user operation and which substantially thermodynamically contracts, sharpens, and cools the head of a razor in an extremely short period of time.

It is finally highly desirable to provide a method and apparatus for cooling the head of a razor which utilizes all of the above mentioned principles.

SUMMARY OF THE INVENTION

It is therefore an object of the invention to provide a method and apparatus for cooling the head of a razor having one or more blades, thereby thermodynamically contracting and sharpening the razor blades and allowing for a more efficient and pleasant shave.

It is also an object of the invention to provide a method and apparatus for cooling the head of a razor which is cost effective and yet efficient in use.

It is also an object of the invention to provide a method and apparatus for cooling the head of a razor which is inherently safe and requires no modification of the razor head itself.

It is also an object of the invention to provide a method and apparatus for cooling the head of a razor which can be utilized on any conventional razor having one or more blades, the apparatus and method being readily modifiable to correspond to the dimensions of any given razor.

It is also an object of the invention to provide a method and apparatus for cooling the head of a razor utilizing structure which allows for ease of user operation and which substantially thermodynamically contracts, sharpens, and cools the head of a razor in an extremely short period of time.

It is finally an object of the invention to provide a method and apparatus for cooling the head of a razor which utilizes all of the above mentioned principles.

Briefly what is provided is a cooling device and method for use in conjunction with a razor having a head which includes at least one blade. Disclosed is a means for containing a coolant, a means for selectively releasing the coolant from the container, and a means for receiving a head of a razor. The receiving means communicates with the releasing means and includes means for exposing the razor head to the coolant when the razor head is placed within the receiving means. Upon activation of the releasing means the head of the razor is exposed to the coolant which substantially cools the razor. The coolant thermodynamically contracts and sharpens the razor blades allowing for a more efficent and pleasant shave.

BRIEF DESCRIPTION OF THE DRAWINGS

The above mentioned and other features and objects of this invention and the manner of obtaining them will be more apparent and the invention itself will be best understood with reference to the following description of embodiments of the invention taken in conjunction with the accompanying drawings, wherein.

DESCRIPTION OF THE PREFERRED EMBODIMENT

Figure 1:
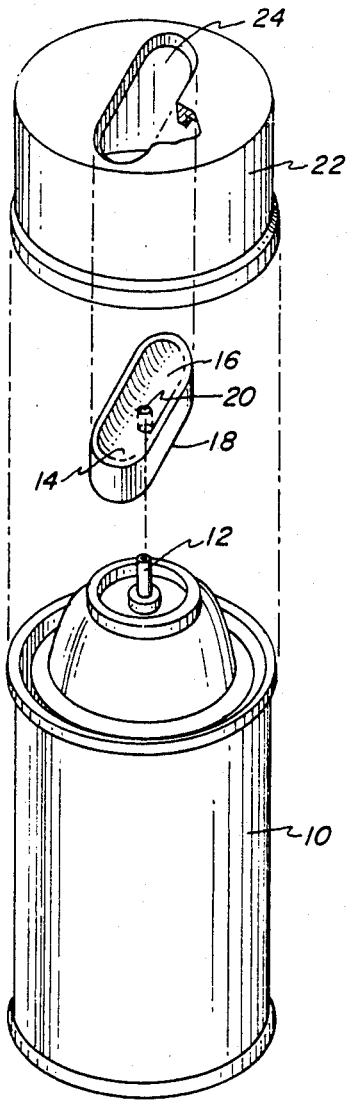
FIG. 1 is a perspective view of an embodiment of the invention illustrating a container housing coolant, a receptacle for receiving the head of a razor, and a cap for enclosing the container top and receptacle.

Referring now to FIG. 1, a container 10 having a nozzle 12, is shown. Container 10 houses a coolant which is released through nozzle 12 upon activation of the nozzle by a user. In a specific embodiment, container 10 can be a conventional can which can house a coolant under pressure, for example, freon.

In accordance with the principles of the invention, any fluid could be utilized which has the properties of substantially cooling a metal upon release from container 10. The fluids can take the form of liquids or gases, and many fluids having the thermodynamic properties will occur to those of ordinary skill in the art.

In conventional form, nozzle 12 is releasably engageable. Nozzle 12 is depressed by a user to allow the coolant to escape from container 10.

Receptacle 14 provides the means for receiving the head of the razor. Receptacle 14, in one embodiment, is of a generally oval shape having a depressed upper surface 16 and lower surface 18. Upper surface 16 forms a trough which receives the head of the razor. The razor head rests within trough 16. Receptacle 14 also has a void 20 which is a passage passing between upper surface 16 and lower surface 18.

In a specific embodiment, receptacle 14 is positioned about nozzle 12 by inserting nozzle 12 within passage 20. Passage 20 is dimensioned to accommodate nozzle 12 and secure receptacle 14 near the top of container 10.

Passage 20 allows for coolant which is released from container 10 to be introduced to the head of a razor which is resting within upper surface 16. Upon engaging nozzle 12 by depressing the head of the razor into receptacle 14, coolant is released from container 10 and thermodynamically contracts, sharpens and cools the head of the safety razor. When a coolant such as freon is utilized, the razor head is depressed for an extremely short period of time, merely a matter of seconds.

In alternative embodiments, receptacle 14 can be of any shape which allows for the insertion of the razor head, and contains a means for allowing the coolant to be introduced to the razor head.

Cap 22 provides a means for enclosing the top of container 10, and the nozzle thereon, as well as receptacle 14. The cap 22 is placed over the receptacle and container, as is more readily shown in FIG. 2.

Cap 22 contains a void 24 which is dimensioned to generally correspond to the upper surface shape of receptacle 14. Void 24 allows a razor to be inserted therethrough and into the receptacle 14. This allows activation of the invention, without requiring the removal of cap 22.

In alternative embodiments cap 22 contains an internal ridge protruding downward from the inside surface of the cap top. The ridge is dimensioned to correspond to the shape of receptacle 14, and stabilizes the receptacle within cap 22. The ridge only allows movement of the receptacle 14 in a vertical direction. This stabilizes the receptacle and thereby prevents its movement in a horizontal or radial direction when positioned within the ridge.

It is clearly understood that the shape of the receptacle 14 and the shape of the void 24 within cap 22 is merely a matter of design choice, and all variations are within the principles of the here described invention.

Figure 2:
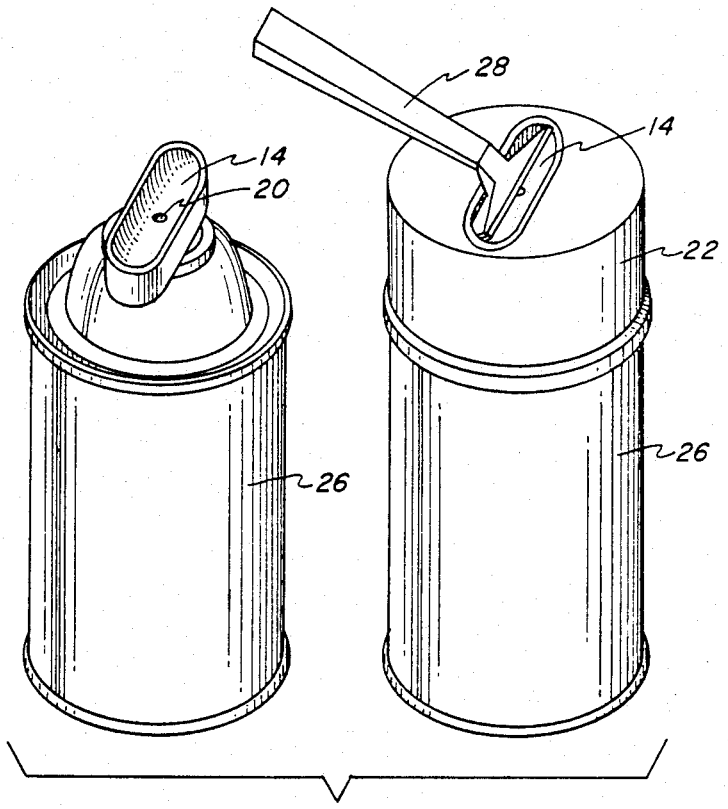
FIG. 2 is a perspective view illustrating an embodiment of the invention in assembled configuration readied for use in conjunction with the razor.

FIG. 2 illustrates the embodiment of the invention 26 with the components assembled. Cap 22 and void 24 allow the insertion of razor head 28 through the void 24 and into receptacle 14. A user merely depresses the razor head 28 into receptacle 14 causing the release of coolant from container 10 to act upon the metal blades of razor head 28.

Figure 3:
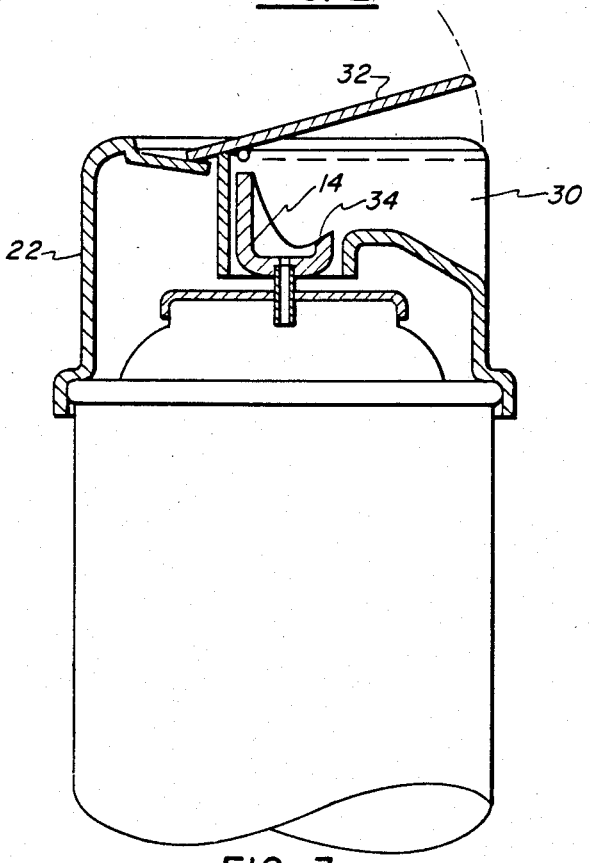
FIG. 3 is an alternative embodiment of the invention illustrating a void located within the side of the container cap.

FIG. 3 illustrates an alternative embodiment of the invention wherein cap 22 contains a void 30 located in the side of cap 22. Also disclosed is a hinged member 32 which can be lifted by a user allowing for the insertion of the razor head through the void 30. The razor rests within receptacle 14. In this embodiment receptacle 14 is modified at side 34 to allow insertion of head 28 into receptacle 14 near the void 30. Thus, the invention contemplates inserting the razor either through the top of a cap of the container, or through the side of the cap, depending on the particular device in issue.

In use, as mentioned above, a user would insert the head of a razor into a receptacle and depress the head of the razor for a short period of time. Upon pressing the receptacle, a nozzle is releasably engaged allowing for the introduction of coolant from a container. The coolant acts upon the metal blades of the razor head and thermodynamically contracts, sharpens, and cools the head of the razor.

The cooling of the steel allows for a substantial sharpening of the blade edge. The invention instantly lowers the temperature of the razor blade to temperatures near or below minus 40° F. A quick burst of the coolant freezes and shrinks the razor's edge of its maximum sharpness. This freezing and cooling allows for a unique shave and suprising sensations acting upon the face of the user. Tests indicate that the shaving time is decreased 8 to 10 seconds by utilizing the present invention.

The metallic blades will increase in strength and hardness when subjected to the extreme cooling temperature differentials of the present invention.

In dry conditions, the razor head will experience a temperature drop to approximately −40° F.

The razor head can also be held under water prior to use with the invention. This causes the additional freezing of the water and a further unique shave.

The present invention utilizes principles which are in direct contradiction of the prior art. Specifically, this invention incorporates means of substantially cooling and freezing the head of a razor which results in increasing sharpness and strength of the metal blades, and providing a shave with a substantially cooled or frozen razor. Unique results are achieved. Prior art teaches away from the present invention by utilizing principles of heating as opposed to cooling or freezing. Similarly, there are no prior art devices utilizing structure similar to that herein disclosed.

While there have been discribed above the principles of this invention in connection with specific apparatus, it is to be clearly understood that this description is made only by way of example and not as a limitation of the scope of the invention. Modifications will occur to those skilled in the art, and all said modifications are deemed to be within the scope of this invention, as indicated by the appended claims.

What is claimed is:

1. A cooling device for use in conjunction with a razor having a head that includes at least one blade, comprising:

means for containing a pressurized, fluid coolant, said containing means including an enclosed housing;

means for releasing said coolant from said containing means, said releasing means including a nozzle, said nozzle releasably engageable, allowing the release of said coolant upon engagement;

means for receiving the head of said razor, said receiving means communicating with said releasing means;

said receiving means including means for exposing said razor head to said coolant; whereupon, activation of said releasing means exposes the blade of said razor to said coolant, cooling, thermodynamically contracting and sharpening said blades, thereby allowing a user an efficient and pleasant shave.

2. The apparatus of claim 1 further comprising means for enclosing said containing means, releasing means and receiving means;

said enclosing means being releasably secured to said containing means.

3. The apparatus of claim 1 wherein said containing means comprises an enclosed, vertically positioned, generally cylindrical metal receptacle having a top and a bottom, said releasing means comprises nozzle stem vertically positioned near the top of said metal receptacle.

4. The apparatus of claim 1 wherein said receiving means comprises a trough, said trough having a lower surface and an upper surface, said upper having a depression therein, said depression dimensioned to accommodate said razor head, said receiving means having a passage therethrough from said lower surface to said upper surface, said passage communicating with said releasing means, said passage allowing said coolant to pass through said trough, thereby cooling a razor head positioned within said trough.

5. The apparatus of claim 4 wherein said receiving means is positioned about, and stabilized by, said nozzle, said nozzle being inserted into said passage.

6. The apparatus of claim 2 wherein said enclosing means comprises a cap having a top and generally cylindrical sides, said top having a void therein, said void corresponding in dimensions to said trough upper surface, said trough being accessible for said razor head without removing said cap from said container.

7. The apparatus of claim 6 wherein said enclosing means further comprises means for stabilizing said receiving means.

8. The apparatus of claim 7 wherein said stabilizing means comprises a ridge positioned about said void, on the interior of said cap, said receiving means positioned within said ridge when said cap is positioned upon said container.

9. The apparatus of claim 2 wherein said enclosing means comprises a cap having a top and generally cylindrical sides, said side having a void therein, said top having a hinged member, whereupon said razor head is positioned within said receiving means through said side of said cap, beneath said hinged top member.

10. A method of cooling the head of a razor, comprising:

providing a container which houses a coolant; said container having a nozzle, said nozzle releasably engageable, allowing the release of said coolant;

providing means for receiving the head of said razor, said receiving means communicating with said nozzle;

placing said razor head within said receiving means;

activating said nozzle by placing said razor head into said receiving means;

whereby said coolant is released from said container and introduced, through said receiving means, to said razor head, thereby thermodynamically contracting and sharpening the blade of said razor head, allowing for an efficient and pleasant shave.

11. The method of claim 10 further comprising:

placing a cap about said container top, said cap having a void therein allowing said razor to be inserted into said receiving means through said cap.

12. The method of claim 11 wherein said void is positioned within the top of said cap.

13. The method of claim 1 wherein said void is placed within the side of said cap.

14. The method of claim 10 wherein said coolant is freon.

* * * * *